United States Patent [19]

Smith

[11] Patent Number: 4,529,260

[45] Date of Patent: Jul. 16, 1985

[54] SELF-RETAINING ELECTRICAL CONTACTS

[75] Inventor: Thomas J. Smith, Bay Shore, N.Y.

[73] Assignee: TII Industries, Inc., Copiague, N.Y.

[21] Appl. No.: 417,550

[22] Filed: Sep. 13, 1982

[51] Int. Cl.[3] ..... H01R 4/24

[52] U.S. Cl. ..... 339/217 S; 339/258 R

[58] Field of Search ..... 339/217 S, 258 R, 258 P

[56] References Cited

U.S. PATENT DOCUMENTS

| | | | |
|---|---|---|---|
| 3,189,868 | 6/1965 | Hatfield | 339/217 S |
| 3,192,498 | 6/1965 | Ruehlemann | 339/217 S |
| 3,311,886 | 3/1967 | Williamson | 339/217 S |
| 3,663,930 | 5/1972 | Henschen et al. | 339/217 S |
| 3,842,396 | 10/1974 | Olsson | 339/217 S |
| 3,963,302 | 6/1976 | Gourley | 339/217 S |
| 4,043,631 | 8/1977 | Lapes | 339/252 R |
| 4,174,877 | 11/1979 | Foederer | 339/217 S |
| 4,179,170 | 12/1979 | Splitt et al. | 339/276 A |
| 4,359,258 | 11/1982 | Palecek et al. | 339/258 R |

FOREIGN PATENT DOCUMENTS 2334526 1/1976 Fed. Rep. of Germany .

*Primary Examiner*—Gil Weidenfeld
*Assistant Examiner*—Gary F. Paumen
*Attorney, Agent, or Firm*—Sachs & Sachs

[57] ABSTRACT

A self-retaining electrically conductive contact suitable for use in insulated terminal blocks and connectors requiring a minimum of spaces between the conductive elements includes a first section which may be formed as a male or female element, a middle section provided with semi-circularly shaped ears which are sloped in a manner to guide the retaining ears around a retaining surface provided in an insulating member when inserted therein and retaining the contact therein once the contact is inserted in the insulated member. The other end section is formed to receive an electrical conductor thereon as required.

19 Claims, 14 Drawing Figures

SELF-RETAINING ELECTRICAL CONTACTS

BACKGROUND OF THE INVENTION

1. Field of the Invention

The present invention relates to electrical contacts, and more particularly, to a self-retaining electrical contact suitable for use in terminal blocks and connectors requiring minimum spacing between conductive elements.

2. Discussion of the Relevant Art

Many types of electrical contacts utilize protrusions or detent devices designed to cooperate with each other in order to retain the electrical contact in a housing or terminal block once inserted therein and require the use of a special tool if removal is required. Typical of this type of contact is disclosed in U.S. Pat. No. 3,842,396 issued to B. E. Olsson on Oct. 15, 1974. The device disclosed therein utilizes a tapered contact element having a pair of ears thereon that are adapted to compress when inserted through an aperture provided to receive the contact. Upon the contact reaching the desired position, the contact ears are permitted to expand to its original position in a slightly larger aperture provided and therefor the contact cannot be withdrawn since the inwardly protruding shoulder of the first aperture retains the contact in position. As constructed, the second aperture must be larger than the first in order to provide the necessary retaining shoulder or surface.

Another type of retaining structure is disclosed in U.S. Pat. No. 3,963,302 issued to C. A. Gourley on June 15, 1976. Disclosed therein is an electrical socket contact which is provided with a pair of extending ears generally lying in the same plane as the rear surface of the contact. The ears are sloped so that the narrower portion thereof is inserted first into an aperture provided in a suitable insulated member. Additional slots are provided on the side of the insulated member and, as the contact is inserted therein from the top surface, the ears are guided into the slots provided on the side of the insulated member and receive the ears therein by a flexing of the housing wall. Once the ears are disposed within the slots provided, withdrawal of the contact is restrained by the ears extending into the slot and are retained by the wall of the insulated member.

A different retaining mechanism is disclosed in U.S. Pat. No. 4,043,631 issued to R. Lapes on Aug. 23, 1977. The contact disclosed therein is provided with a pair of inwardly disposed recesses on narrowly extending feet of the contact. The narrowly extending feet are resilient and, when inserted into an insulated member provided with an aperture therefor, flex towards each other permitting the inwardly extending recesses to be inserted into an insulated member beyond inwardly extending mated protrusions provided in the aperture. When in position, the recesses on the contact return to their original position encompassing the protrusions and, thus, retain the contact in position in the insulated member. Mating with a cooperating contact is accomplished by lateral movement of the mating circuit.

The instant invention has been designed to overcome the shortcomings of the prior art by providing a simple self-retaining electrically conductive contact that utilizes a minimum of space permitting tight packaging and proximity of the electrical contacts without requiring lateral motion by the mating device.

SUMMARY OF THE INVENTION

Therefore, the instant invention has been designed to overcome the shortcomings found in the prior art which require additional space for the retaining mechanism and/or require lateral movement of the connector for contact purposes.

Therefore, it is an object of the present invention to provide a self-retaining electrical contact suitable for use in terminals and connectors requiring close proximity between the contacts.

It is another object of the present invention to provide a simple, inexpensive, electrical contact terminal that is self-retaining.

It is yet another object of the present invention to provide a self-retaining electrical contact that does not require additional space to accomodate the self-retaining feature.

Yet another object of the present invention is to provide a self-retaining contact which may be made of the male or female type.

The foregoing and other objects and advantages will appear from the description to follow. In the description, reference is made to the accompanying drawing which forms a part hereof, and on which is shown, by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENTS

Figure 1:
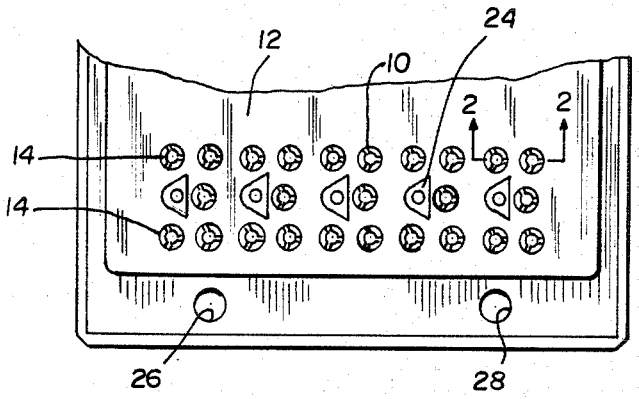
FIG. 1 is a top plan view of a portion of a multi-contact terminal block, utilized in the principles of the present invention.
Figure 2:
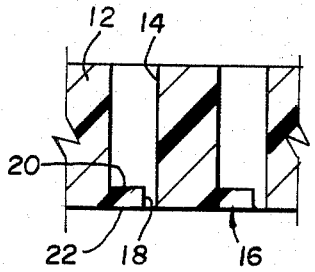
FIG. 2 is an enlarged cross-sectional view taken along the line 2—2 of FIG. 1.
Figure 3:
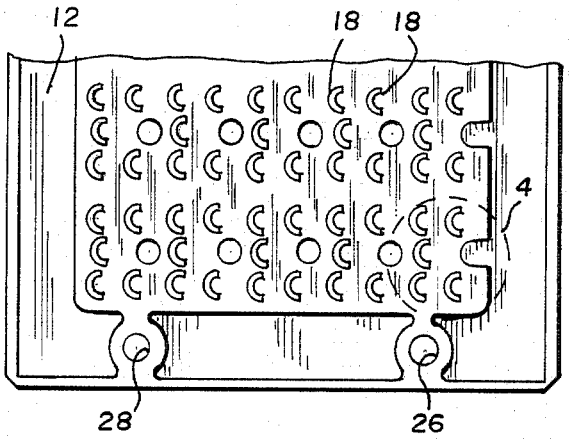
FIG. 3 is a partial, bottom plan view of the connector shown in FIG. 1.
Figure 4:
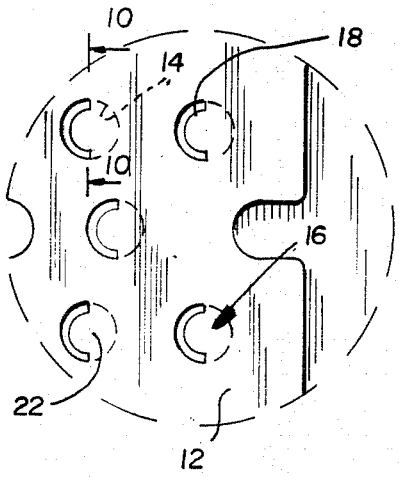
FIG. 4 is an enlarged view of the portion within the broken dotted line of FIG. 3.

Referring now to the figures and, in particular, to the FIGS. 1 through 4, there is shown a plurality of self-retaining electrical contacts 10 inserted in an insulated terminal board 12 that is provided with a plurality of bore holes or apertures 14 suitable for receiving the self-retaining contacts therein. The self-retaining electrical contacts 10 are shown greatly enlarged in the remaining figures. The terminal board 12, preferably utilized in the instant invention, is manufactured from an insulating material manufactured by the General Electric Company, Syracuse, N.Y., and known by the trade name of LEXAN.

The bore holes 14 provided in terminal board 12 are lined in a closely knit pattern specifically for receiving miniaturized overvoltage line protectors utilized in the telephone central office to protect the equipment connected thereto. A typical line protector is disclosed in U.S. Pat. No. 4,424,546 to T. J. Smith, issued Jan. 3, 1984 and entitled MINIATURE CENTRAL OFFICE SURGE PROTECTORS. Although a terminal board has been disclosed herein as being the preferred embodiment, it is obvious to those knowledgeable in the art that the self-retaining electrical contacts disclosed herein may be utilized in connector assemblies as well as the terminal board disclosed herein.

The remaining wall 16, at the bottom of the bore hole 14, is provided with a semi-circularly shaped slot or aperture 18 through which the electrical contacts 10 are inserted. The upper surface 20 and lower wall portion 22 of the remaining wall 16 function as a retaining surface for the contact 10 as will be explained hereinafter.

The terminal board 12 is also provided with a pyramidally-shaped protrusion 24 which cooperates with the base of the miniature surge protectors and helps in alignment of the mating male conductor pins, not shown, when the surge protector assemblies are inserted into the terminal board.

The terminal board 12 is also provided with holes 26 and 28 for easier mounting to a surface. The terminal board as disclosed is manufactured in a conventional manner by injection molding and all of the apertures and protrusions are formed in the mold and it only remains for the contacts 10 to be inserted therein to complete the assembly.

Figure 5:
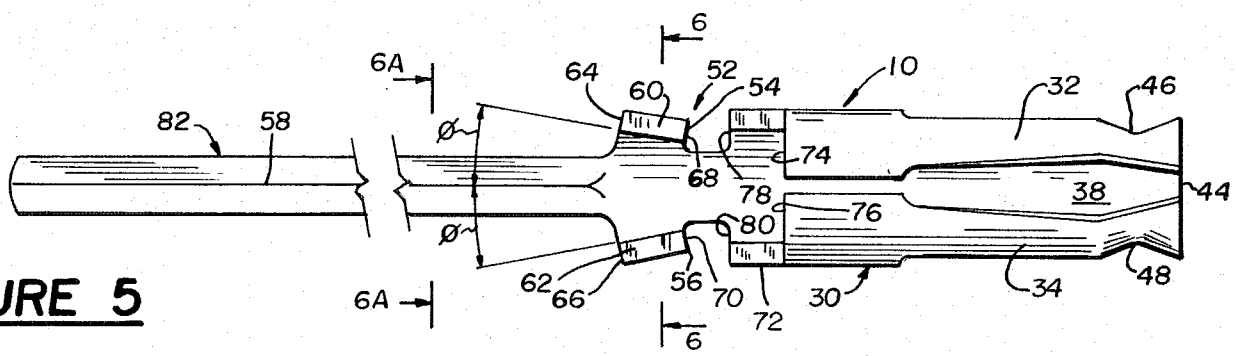
FIG. 5 is an enlarged top plan view of one embodiment of the self-retaining electrical contact.
Figure 7:
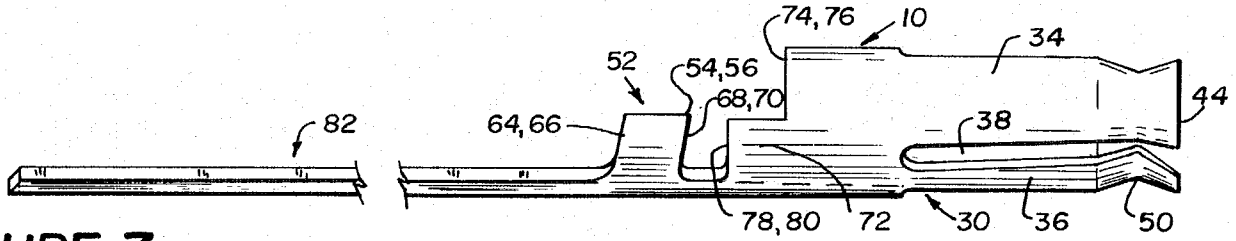
FIG. 7 is an enlarged side view in elevation of the embodiment shown in FIG. 5.

Referring now to FIG. 5 which discloses an enlarged self-retaining electrical contact 10 suitable for insertion in the terminal board 12. The contact 10 is provided with an elongated end section 30 having three fingers 32, 34, and 36 preferably disposed 120 degrees apart with slots 38, 40 and 42 provided therebetween so that a male pin conductor inserted in the circularly-shaped opening 44 may cause them to flex to receive the male contact, not shown, and be retained therein by the dimpled portions 46, 48 and 50 provided proximate the distal ends of each of the fingers 32, 34 and 36.

Figure 6:
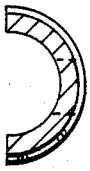
FIG. 6 is a cross-sectional view taken along the line 6—6 of FIG. 5.

The contact 10 is provided with a middle section 52 having a pair of outwardly extending ears 52 and 56 which are disposed transverse to the longitudinal axis 58 of the contact. When viewed in cross-section, as shown in FIG. 6, the ears 54 and 56 are seen to be generally semi-circularly shaped. The distal ends 60 and 62 of ears 54 and 56 are sloped in an inwardly direction towards end section 30 of the contact 10 at an angle phi ($\phi$) of between 5 and 30 degrees, preferably 10 degrees, relative to the longitudinal axis 58. The ears 54 and 56 because of their preferred shape, function as a guiding and retaining means by permitting the leading edges 64 and 66 of ears 54 and 56, respectively, to flex around the remaining wall 16 appearing at the bottom of bore holes 14 when contact 10 is inserted therein. Since the rear or trailing edges 68 and 70 are smaller in diameter than the lower surface 22 of the remaining wall 16, the contact 10 having passed beneath the wall will be prevented from moving out of bore hole 14 by the ears 54 and 56, which will be explained in more detail hereinafter. The middle section 52 is additionally provided with an additional guiding portion 72 that is semi-circularly shaped and positions the contact 10 in the slot 18 permitting the leading edges 74 and 76 of fingers 32 and 34 to sit on the upper surface 20 of wall 16, thereby preventing the contact 10 from passing completely through the bore hole 14 when a mating connector is inserted therein. Slots 78 and 80 are cut in the middle section 52 in order to permit the sloping of the distal ends 60 and 62 of ears 54 and 56.

Figure 6A:
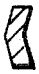
FIG. 6*a* and 6*b* are cross-sectional views taken along the line 6*a*—6*a* of FIG. 5.
Figure 6B:
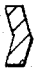

The contact 10 also includes a second end section 82 which is generally elongated and may be formed with a concave or convex surface as shown in FIGS. 6*a* and 6*b* to increase its strength. End section 82 may be utilized with a wire wrapping tool or by soldering electrically conductive wire thereto in a conventional manner. Preferably the contact is manufactured from phosphor bronze or beryllium copper with a tin plate thereon but may be fabricated from any other suitably resilient electrically conductive material.

Figure 8:
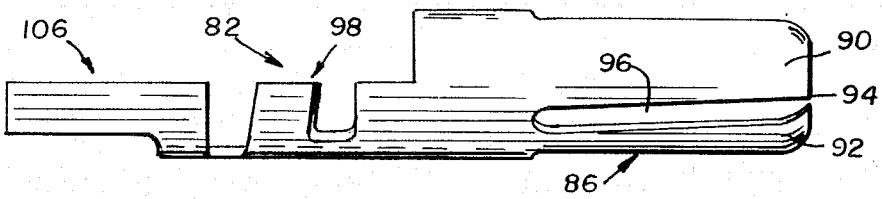
FIG. 8 is an enlarged side view in elevation of an alternative embodiment of the self-retaining electrical contact, according to the principles of the present invention.
Figure 9:
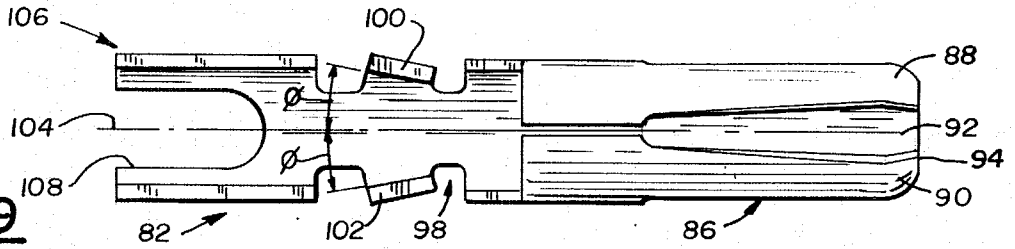
FIG. 9 is a top plan view of the embodiment shown in FIG. 8.

Referring now to FIGS. 8 and 9, there is disclosed an alternative embodiment 84 of the instant invention. The mating end section 86 thereof is formed with three fingers 88, 90 and 92 with the distal ends thereof bent inwardly forming an essentially closed or male end 94 which may be received by a female receptacle provided in a contact such as that disclosed hereinbefore. Here again, preferably, the fingers are displace 120 degrees and are provided with slots 96 therebetween.

The middle section 98 of embodiment 84 is constructed identical to the middle section 52 of contact 10. The outwardly extending ears 100 and 102 are angled at an inwardly direction towards the mating end section 86 at an angle phi ($\phi$) to the transverse axis 104 which, preferably, is 10 degrees and may be as large as 30 degrees.

The other end section 106 is provided with a U-shaped longitudinally extending portion having an elongated slot 108 disposed therein, of a predetermined diameter suitable for retaining an electrically conducting wire therein, which may be permanently affixed by conventional soldering techniques.

Figure 12:
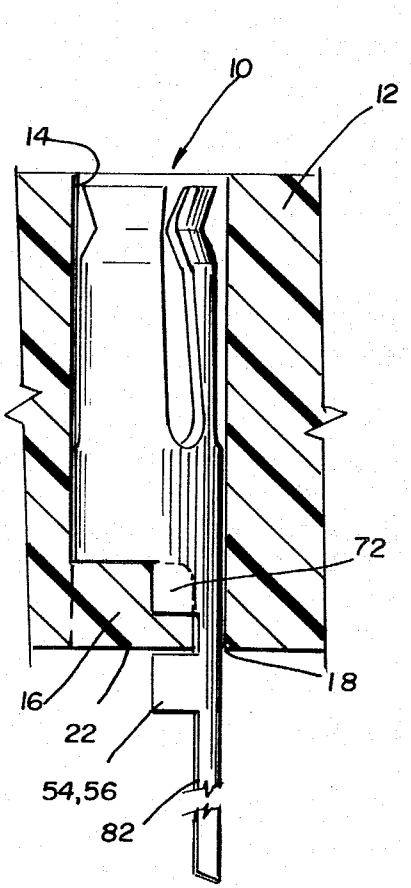
FIG. 12 is a side view in elevation of the contact inserted in the insulated member as shown in FIG. 11.
Figure 11:
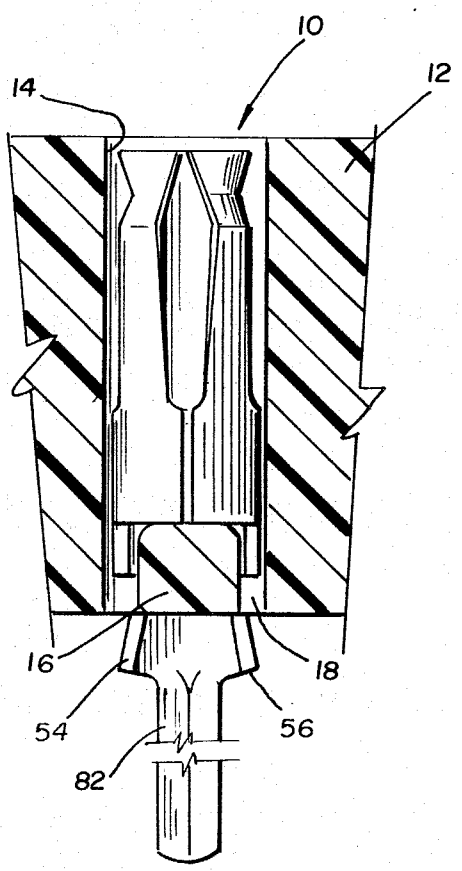
FIG. 11 is a cross-sectional view taken along the line 10—10 of FIG. 4 after the contact has been fully inserted into the insulated member.
Figure 10:
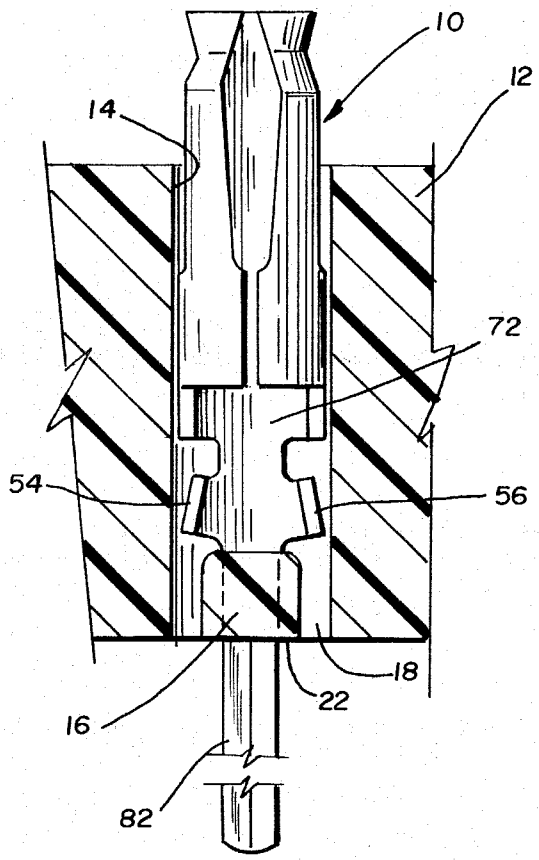
FIG. 10 is an enlarged partial view of the contact disclosed in FIG. 5 just prior to complete insertion in an insulated member taken along the line 10—10 of FIG. 4.

Referring now to FIGS. 10, 11, and 12, there is disclosed an enlarged cross-sectional view of the embodiment 10 being inserted into an insulated member or terminal board 12. The contact 10 is guided into bore 14 by means of end section 82 being inserted into the semi-circularly shaped slot 18. As the contact 10 is depressed further into the bore, the ears 54 and 56 are guided over the remaining wall 16 at the bottom of bore 14, expanding thereover as the contact 10 is inserted all the way into the insulated member 12. Upon ears 54 and 56 extending to the lower surface 22 of wall 16, the trailing edge 68 and 70 of ears 54 and 56 return to their original position and come into contact with surface 22 thereby preventing the contact 10 from being removed from the insulated material 12 if a force should be exerted on contact 10 in an upwardly direction, such as that caused by removing a mating male contact. The auxiliary guiding portion 72 seats the contact around the wall 16 while it is positioned in the semi-circular shaped slot 18 and prevents rotation of the contact in the bore hole 14 together with the pre-formed shape of the end section 82.

Hereinbefore has been disclosed a self-retaining electrical contact suitable for use in a terminal board or connector requiring close proximity of the electrical contacts. It will be understood that various changes in the details, materials, arrangement of parts and operating conditions which have been herein described and illustrated in order to explain the nature of the invention, may be made by those skilled in the art within the principles and scope of the instant invention.

Having thus set forth the nature of the invention, what is claimed is:

1. A self-retaining electrically conductive contact for use in insulated terminal blocks and connectors comprising:

(a) a first elongated end section formed to cooperate with a mating electrically conductive contact;

(b) a middle section, said middle section being provided with a pair of transversely outwardly extending ears, said ears being generally semi-circularly shaped when viewed in cross-section, the distal ends of said outwardly extending ears being sloped inwardly towards said first end section at an angle to the longitudinal axis of said contact, said ears guiding said contact into a receiving aperture through and around a retaining wall portion provided in a terminal block when said contact is inserted therein; and (c) a second end section being formed to receive an electrical conductor thereon, said second end section being the first end inserted into said terminal block.

2. A self-retaining contact according to claim 1 wherein said first section is formed as a female socket.

3. A self-retaining contact according to claim 1 wherein said first section is formed as a male plug.

4. A self-retaining contact according to claim 1 wherein said second section is formed to receive a wrap around wire conductor thereon.

5. A self-retaining contact according to claim 1 wherein said angle is between 5 and 30 degrees.

6. A self-retaining contact according to claim 1 wherein said first and second end sections are formed from a unitary metal blank.

7. A self-retaining contact according to claim 5 wherein said angle is approximately 10 degrees.

8. A terminal block or connector having self-retaining electrically conductive contacts comprising:

(a) an insulated member having a plurality of bore holes with a bottom wall adapted to receive a conductive contact therein, each of said bore holes being provided with a semi-circularly shaped aperture in said bottom wall thereof, forming a lower retaining surface; and, (b) electrically conductive contacts adapted to be received by each of said bore holes and retained therein, said conductive contacts including:

(i) one elongated end section formed to cooperate with a mating electrically conductive contact;

(ii) a middle section having guiding and retaining means for guiding said contact through said semi-circularly shaped aperture provided in said bottom wall, said guiding and retaining means retaining said contact in said bore hole when said contact comes in contact with said lower retaining surface; and, (iii) the other end section being formed to receive an electrical conductor thereon, said other end section being the first end inserted into said insulated member.

9. A terminal block or connector according to claim 8 wherein said guiding and retaining means includes a pair of transversely outwardly extending ears having a leading edge and a trailing edge and being generally semi-circularly shaped when viewed in cross-section, the distal ends of said outwardly extending ears being sloped inwardly from said leading edge towards said trailing edge at an angle to the longitudinal axis of said contact, said leading edge being the first to enter said insulated member upon insertion therein and said trailing edge retaining said contact within said insulated member by contacting said member lower retaining surface.

10. A terminal block or connector according to claim 8 wherein said one section is formed as a female socket.

11. A terminal block or connector according to claim 8 wherein said one section is formed as a male plug.

12. A terminal block or connector according to claim 8 wherein said other section is formed to receive a wire conductor.

13. A terminal block or connector according to claim 9 wherein said angle is between 5 and 30 degrees.

14. A terminal block or connector according to claim 13 wherein said angle is approximately 10 degrees.

15. A terminal block or connector according to claim 8 wherein said other end section is formed to cooperate with said semi-circularly shaped aperture and position said middle section.

16. A self-retaining electrically conductive contact for use in insulated terminal blocks and connectors, comprising:

(a) one elongated end section formed to cooperate with a mating electrically conductive contact;

(b) a middle section having guiding and retaining means for guiding said contact through an aperture and around a retaining surface provided in an insulated member and retaining said contact when said contact is inserted therein; said guiding and retaining means including;

(i) a pair of transversely outwardly extending ears having a leading edge and a trailing edge and being semi-circularly shaped when viewed in cross-section, the distal ends of said outwardly extending ears being sloped inwardly from said leading edge towards said trailing edge at an angle to the longitudinal axis of said contact, said leading edge being the first to enter an insulated member upon insertion therein and said trailing edge retaining said contact within said insulated member by contacting said member retaining surface; and (c) the other end section being formed to receive an electrical conductor thereon, said other end section being the first end inserted into said insulated member.

17. A self-retaining electrically conductive contact according to claim 16 wherein said other end section is formed for wrapping therearound a wire conductor, said wire conductor being adapted to be wrapped around said other end section after installation of said contact in said terminal block.

18. A self-retaining electrically conductive contact according to claim 16 wherein said angle is between 5 and 30 degrees.

19. A self-retaining electrically conductive contact according to claim 18 wherein said angle is approximately 10 degrees.

* * * * *